US005343575A

United States Patent [19]

Cartwright

[11] Patent Number: 5,343,575

[45] Date of Patent: Sep. 6, 1994

[54] PORTABLE BATHING UNIT

[76] Inventor: Floyd Cartwright, 310 Gelpi Dr., Lake Charles, La. 70601

[21] Appl. No.: 116,505

[22] Filed: Sep. 3, 1993

[51] Int. Cl.[5] ..... A61H 33/00

[52] U.S. Cl. ..... 4/547; 4/541.1; 5/900

[58] Field of Search ..... 4/547, 665, 541.1, 541.2; 5/900, 12.1, 510, 900.5

[56] References Cited

U.S. PATENT DOCUMENTS

| | | | |
|---|---|---|---|
| 569,001 | 10/1896 | Bock | 4/547 |
| 630,416 | 8/1899 | Smith | 4/547 |
| 652,744 | 7/1900 | Carman | 4/547 |
| 1,077,199 | 10/1913 | James | 4/547 |
| 1,325,488 | 12/1919 | Mowat | 4/547 |
| 2,611,341 | 9/1952 | Paris . | |
| 2,876,020 | 3/1959 | Murchie | 5/510 |
| 3,157,774 | 11/1964 | Moore et al. . | |
| 3,955,221 | 5/1976 | Finch . | |
| 4,074,370 | 2/1978 | Harmony, III . | |
| 4,197,838 | 4/1980 | Shill . | |
| 4,207,629 | 6/1980 | Kagawa . | |
| 4,555,821 | 12/1985 | Page | 5/12.1 |
| 4,821,348 | 4/1989 | Pauna | 4/547 |
| 4,879,774 | 11/1989 | Sanders | 5/510 |
| 4,954,179 | 9/1990 | Franninge | 4/541.1 |
| 5,038,421 | 8/1991 | Harris | 5/12.1 |
| 5,079,784 | 1/1992 | Rist et al. | 4/541.2 |

FOREIGN PATENT DOCUMENTS

| | | | |
|---|---|---|---|
| 3717963 | 12/1988 | Fed. Rep. of Germany | 4/665 |
| 1005387 | 12/1951 | France . | |
| 1282387 | 12/1961 | France . | |

*Primary Examiner*—Henry J. Recla
*Assistant Examiner*—Charles R. Eloshway
*Attorney, Agent, or Firm*—Richard C. Litman

[57] ABSTRACT

A portable bathing unit for use with bedridden patients is disclosed. The bathing unit includes a bath tub supported by a carriage which is movably positionable in the proximity of a patient. Casters depend from the bottom of the carriage housing to permit the portable bathing unit to be rolled along in an upright posture. Additional casters are also attached to the rear of the housing which permit the portable bathing unit to be turned up on its rear and transported through narrow doorways. Water delivery and retrieval is accomplished through the use of a submersible pump and a segment of conduit. A whirlpool bath tub may be employed if desirable. When the bath tub is not in use, the portable bathing unit is convertible into an article of furniture. The housing of the carriage forms armrests and a backrest, and a cover conceals the bathing chamber and forms a seat. A valance drapes around the bottom of the carriage to conceal the casters thereunder. Is should be noted that the casters elevate the housing so as to permit the legs of a hoist to pass thereunder and permit the boom of the hoist to extend over the bath chamber.

2 Claims, 6 Drawing Sheets

PORTABLE BATHING UNIT

BACKGROUND OF THE INVENTION

1. Field of the Invention

The present invention relates to a bath tub and, more particularly, to a portable bathing unit for use in hospitals and/or with bedridden patients.

2. Description of the Prior Art

Existing provisions for bathing a bedridden patient are limited. The patient must either be hoisted from his or her bed and transported to a location where a bath tub preexists or be given sponge bath while remaining in their bed. Difficulty arises in transporting the patient to and from the bath tub in that a risk of injury to the patient is increased proportionally with the distance in which a patient must be transported to the bath tub. With respect to sponge baths, sponge baths are not as thorough as bathing in a bath tub. A need prevails for a portable bathing unit which may be located in the proximity of a patient.

Portable bathing units have been the subject of patent protection in the prior art of record. In particular, U.S. Pat. Nos. 4,074,370, issued Feb. 21, 1978 to George W. Harmony, III, and No. 4,207,629, issued Jun. 17, 1980 to Hideo Kagawa, both disclose a portable bathing unit for use in bathing bedridden patients. The patent issued to Harmony describes a tub portion and a plurality of legs depending therefrom. A lockable caster is included on the lower end of each leg. A pump is operatively connected to a drain conduit for pumping water from the tub portion. A filling hose is provided for introducing water into the tub portion. Harmony suggests that it is well known to provide a cover for the tub portion to maintain the water temperature at a desired level and to provide a filling conduit for filling the tub portion from a remote location. The patent issued to Kagawa teaches a bath tub fitted into a rectangular frame of a carriage from above. The bath tub is slanted by a crane disposed thereunder so that a portion thereof is lowered to the floor to allow ease in helping a patient into and out of the bath tub. Features such as a drain plug for draining the bath tub, a foot step which the patient crosses upon entering into the tub, and handle rods for locking certain of the carriage wheels are provided.

A portable bath for physiological heat treatment is disclosed in U.S. Pat. No. 3,157,774, issued Nov. 17, 1964 to Jack E. Moore et al. The Moore et al. patent describes a cabinet supported on casters and having sides provided with handles for easy carrying. The top of the cabinet has a central opening to give access to a treatment liquid. The opening may be covered by a cover when the portable bath is not in use.

In U.S. Pat. No. 4,197,838, issued Apr. 15, 1980 to Wilson T. Shill, a mobile bath tub supported by four wheels is disclosed. Water supplied by a pump is circulated into and out of the interior of the bath tub. A control adjusts the operation of the pump to produce a relaxing, pulsating effect.

Other patents deemed of interest include U.S. Pat. Nos. 2,611,341, issued Sep. 23, 1952 to Hugh P. Paris, and No. 3,955,221, issued May 11, 1976 to Eve B. Finch; and French Patents No. 1.005.387, granted Dec. 19, 1951 to M. Maurice Bouchet, and No. 1.282.387, granted Dec. 11, 1961 to Hugo Buscaglia.

A bathing unit which is comfortable for adult use and easily transportable from location to location, which may be filled and drained at virtually any location, and which provides sufficient floor clearance for the legs of a hoist to pass thereunder, resolves problems associated with existing bathing units. Further, if such a bathing unit were convertible into an article of furniture, the same would not only be useful for sitting or lying upon when not in use as a bath tub, but would be aesthetically appealing as well.

None of the above patents, taken either singly or in combination, is seen to describe the instant invention as claimed.

SUMMARY OF THE INVENTION

The present invention is a portable bathing unit for use with invalids or bedridden patients. The bathing unit is movably positionable in the proximity of a patient's bed and includes a bath tub supported by a carriage. The carriage includes a housing constructed of a rectangular frame and a plurality of panels. The frame is dimensioned so as to snugly receive the bath tub. The bath tub includes a bathing chamber being dimensioned to accommodate an adult.

The bath tub is supported by the housing with panels attached to the inner surfaces of the ends and the back of the frame forming inner end and rear walls of the housing. These panels extend downwardly to meet the upper edge of the bath tub and overlap the peripheral flange of the bath tub. A piece of trim extends longitudinally along the front of the housing to overlap the skirt. The panels in cooperation with the piece of trim hold the bath tub securely in the housing. Outer panels are attached to the outer surfaces of the frame forming outer end and rear walls of the housing. These panels are preferably padded and covered with a fabric covering.

Casters on the bottom of the housing permit the portable bathing unit to be rolled, and thus, moved in an upright posture. Casters are also attached to the outer rear wall of the housing which permits the portable bathing unit to be turned up on its rear and transported through most conventional size doorways.

Water delivery and retrieval is accomplished through the use of a submersible pump and a segment of conduit, such as conventional garden hose. The portable bathing unit is filled by transferring water from a preexisting vessel, such as a bath tub, to the portable bathing unit via the submersible pump and garden hose. After use, the portable bathing unit is drained by transferring the water back to the preexisting tub also through the aid of the submersible pump and the garden hose. No special faucets or adapters are required to fill and drain the portable bathing unit.

The portable bathing unit may include a whirlpool bath tub which operatively allows the user to customize the water flow through each whirlpool jet independently.

When the portable bathing unit is not being used for bathing, the same is convertible into an article of furniture, such as a bed or a sofa. The end and rear walls of the housing extend upwardly beyond the upper edge of the bath tub so as to form armrests and a backrest. A cover conceals the bath chamber and forms a seat. The cover has a cushioned upper surface and is wrapped with a durable fabric. The lower surface of the cover has a pair of handles extending therefrom which permit the same to be easily maneuvered by the user. A valance drapes around the bottom of the carriage to conceal the space and the casters thereunder.

The portable bathing unit may be conveniently located in a patient's sleeping quarters to minimize the risk of harmful incidents which may occur while transporting the patient to and from the portable bathing unit. The casters elevate the frame high enough above the floor to permit the legs of a hoist (for carrying a patient) to pass thereunder and to permit the boom of the hoist extend over the bath chamber.

Accordingly, it is a principal object of the invention to provide a portable bathing unit for use in hospitals and/or with bedridden patients.

It is another object to provide such a portable bathing unit that facilitates movement of a patient from the patient's bed to the portable bathing unit and vice versa with relative ease, even through substantially narrow doorways.

It is a further object that the portable bathing unit be filled from and drained to a remote location.

Still another object is that the portable bathing unit be comfortable for use by an adult.

It is yet another object that the portable bathing unit be convertible so as to form an article of furniture for sitting or lying upon when the bath tub is not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
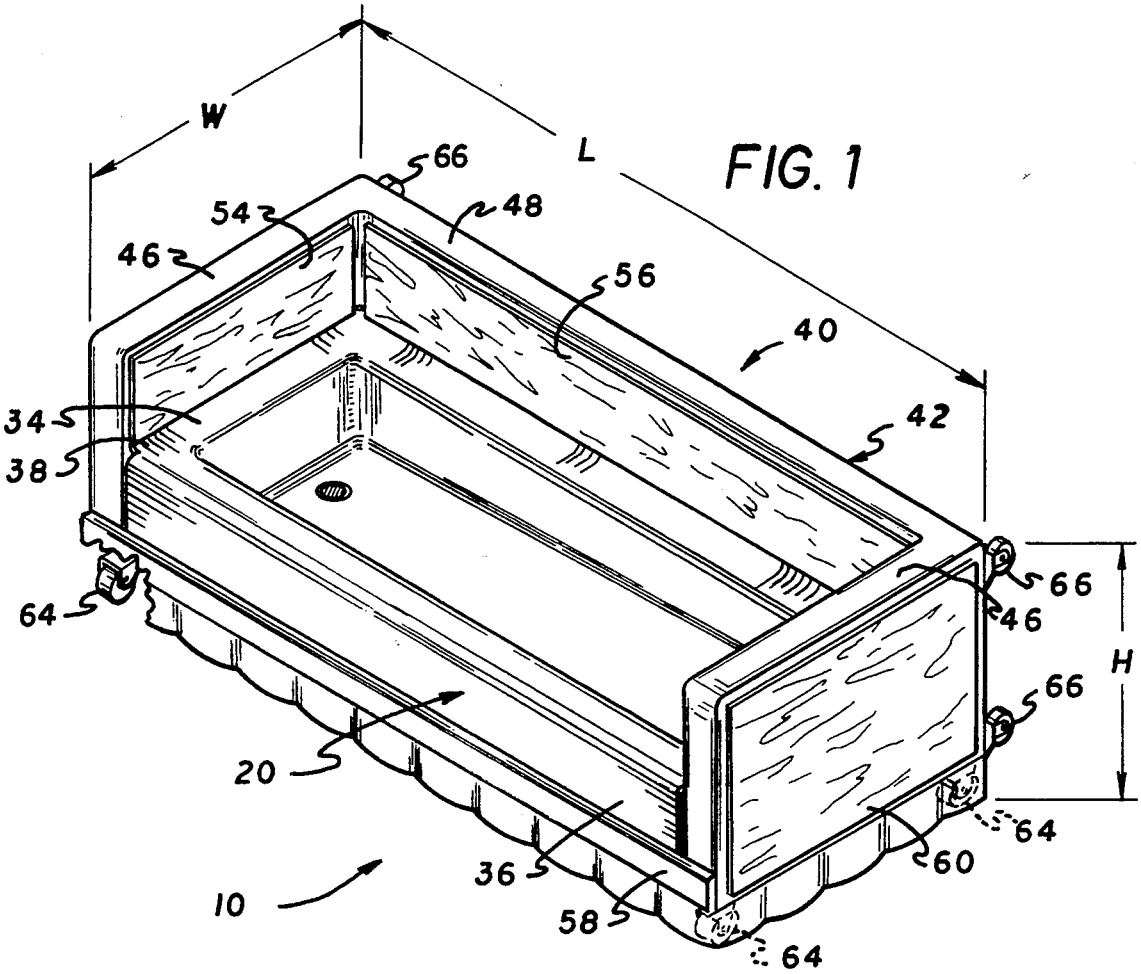
FIG. 1 is a front perspective view of a portable bathing unit according to the present invention.

The present invention, as shown in FIG. 1, is a portable bathing unit 10 for use in hospitals or with invalids or bedridden patients. The bathing unit 10 is movably positionable in the proximity of a patient's bed. In an institutional environment, such as a hospital or a convalescence home, the bathing unit 10 is transportable so as to service patients in various locations. The bathing unit 10 includes a bath tub 20 supported by a carriage 40 and is dimensioned for adult use. The bathing unit 10 may be of a unitary construction or the bath tub 20 and the carriage 40 may be configured separately to permit conventionally available bath tubs to be used in assembling the portable bathing unit 10.

Figure 2:
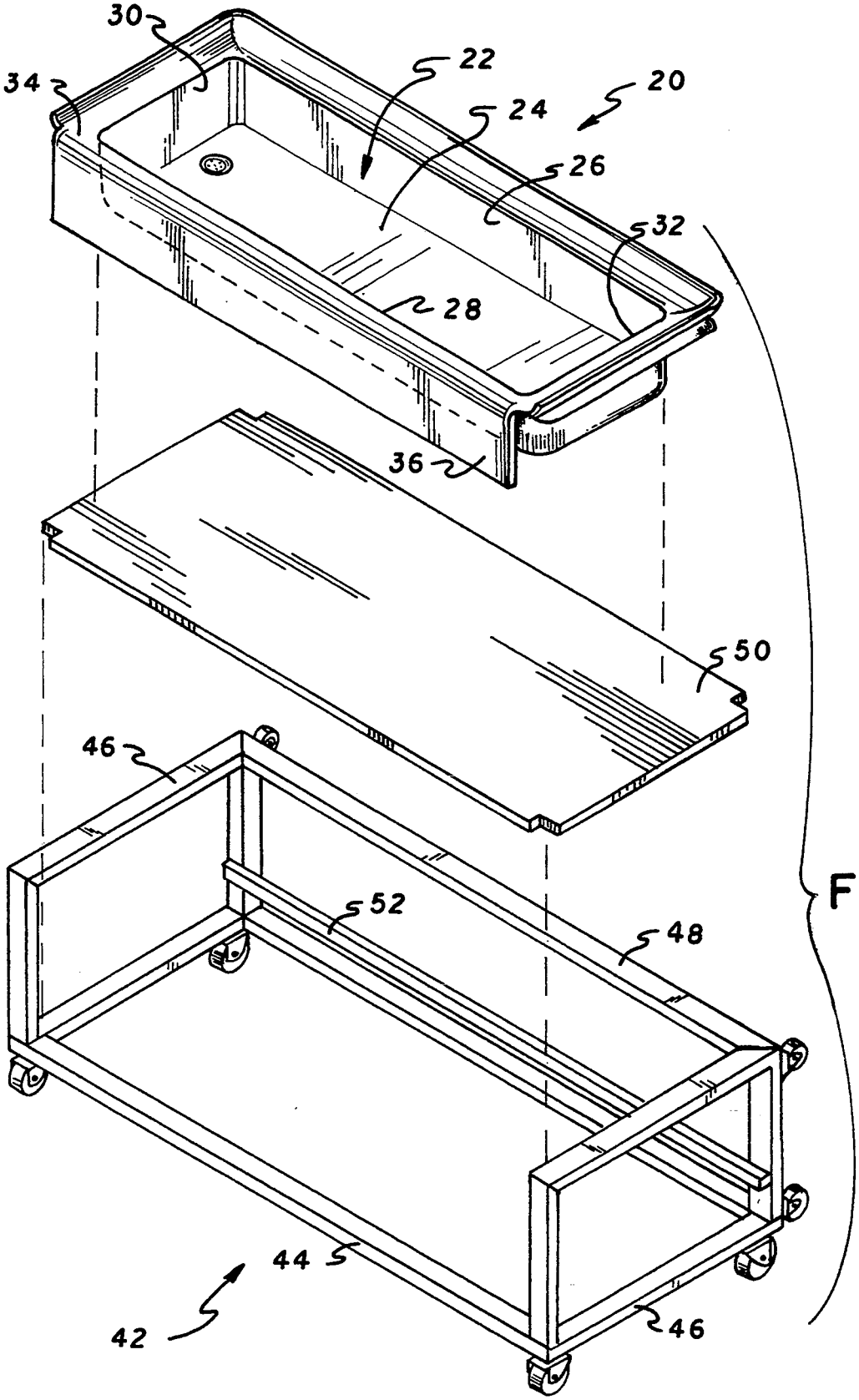
FIG. 2 is a partially exploded, partial front perspective view of the portable bathing unit.

The carriage 40 is constructed of a rectangular frame 42, as shown in FIG. 2, formed so as to carry the bath tub 20 therein. The frame 42 includes a horizontally disposed bottom 44, two laterally extending ends 46, and a longitudinally extending rear 48. The frame 42 should be formed from a sturdy yet lightweight material, such as wood, fiberglass, or aluminum, capable of supporting at least 400 pounds (180 kg), depending on the weight of the tub 20, the volume of water the tub 20 can hold, and the weight of the patient. The frame 42 may be assembled with adhesive and/or threaded fasteners, or may be formed or welded, depending on the composition of materials from which it is formed.

The bath tub 20 is preferably molded as a separate component from fiberglass or other sturdy but lightweight moldable material covered with a conventional acrylic coating. The bath tub 20 includes an interior 22 which forms a bath chamber 22. The bathing chamber 22 includes a bottom surface 24, a front and a rear 26, 28 and two ends 30, 32. The front and rear 26, 28 and ends 30, 32 curve upwardly over an upper edge 34 and the front 26 further curves downwardly to form an outer side wall 36 or skirt.

The bath chamber 22 is dimensioned and configured so as to receive comfortably an adult human body therein. The minimum length and width of the bath tub 20 are preferably five feet (1.5 m) long and two and one-half feet (75 cm) wide, respectively, which is the approximate size of a conventional bath tub.

The frame 42 is dimensioned so as to snugly receive the bath tub 20 therein. The bottom 44 of the frame 42 has attached thereto a subpanel 50, preferably formed from a $\frac{3}{4}$ inch (2 cm) thick piece of plywood. The ends 46 and the rear 48 of the frame 42 extend upwardly from its bottom surface 44. The rear 48 extends between and is attached to the ends 46. A horizontal support 52 is disposed along the rear 48 a predetermined distance upward from the bottom 44 of the frame 42. The horizontal support 52 extends the length of the rear 48 of the frame 42.

Figure 3:
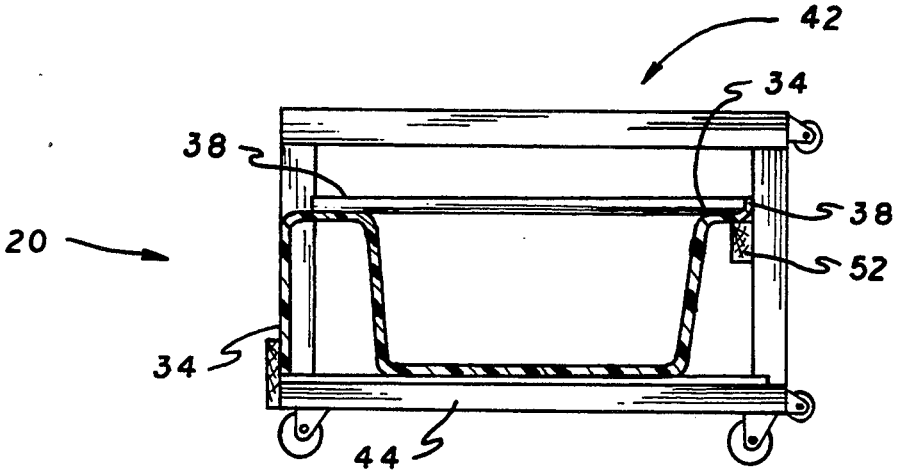
FIG. 3 is a cross-sectional view of the portable bathing unit.

As shown in FIG. 3, the rear underside of the upper edge 34 of the bath tub 20 is vertically supported by the horizontal support 52. The front lower edge of the skirt 36 of the bath tub 20 is vertically supported by the front edge of the bottom 44 of the frame 42. The bath tub 20 includes a peripheral flange 38 which extends upwardly from the ends and rear of the upper edge 34 of the bath tub 20.

Referring back to FIG. 1, with the bath tub 20 is supported by the frame 42, panels 54, 56, preferably $\frac{1}{4}$ inch (0.6 cm) thick, are attached to the inner surfaces of the ends 46 and the rear 48 of the frame 42. The panels 54, 56 extend downwardly to meet the upper edge 34 of the bath tub 20 and overlap the peripheral flange 38. A piece of trim 58 extends longitudinally along the front edge of the bottom 44 of the frame 42 and extends upward to overlap the skirt 36 or a portion thereof. The panels 54, 56, in cooperation with the piece trim 58, hold the bath tub 20 securely within the frame 42.

Figure 7:
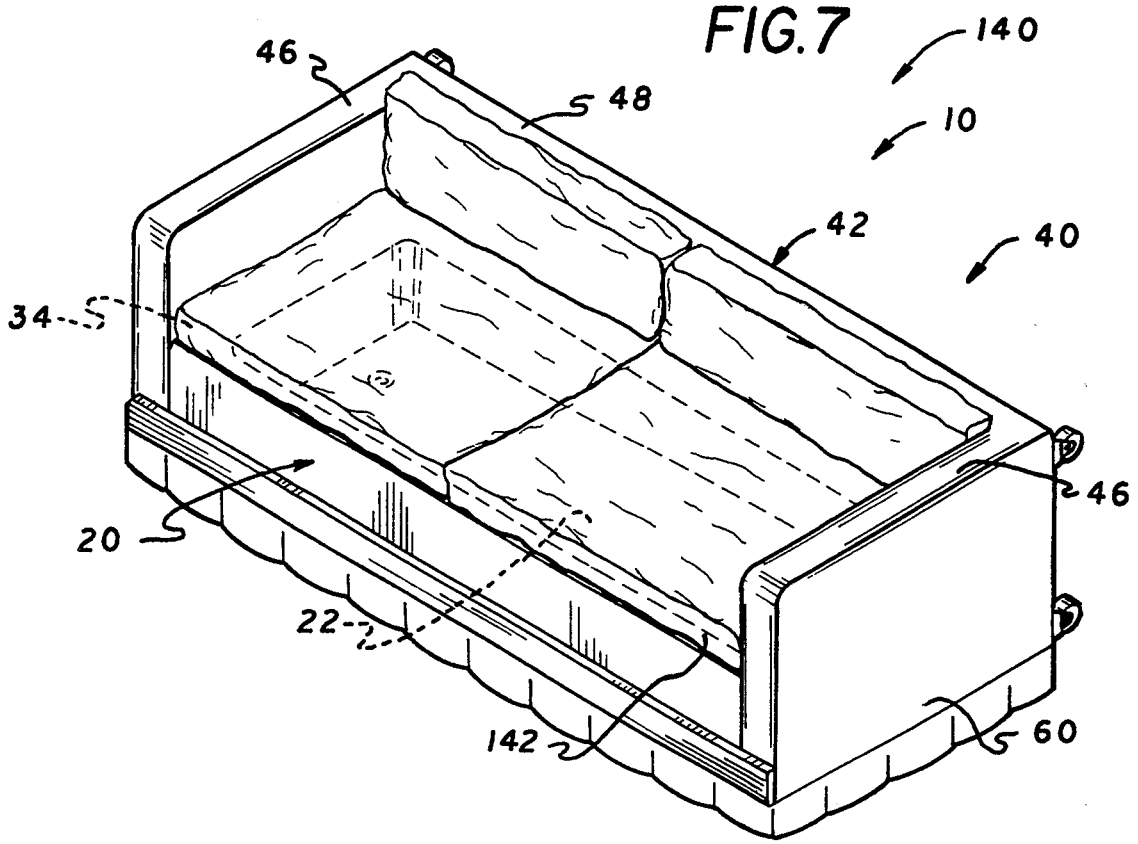
FIG. 7 is a perspective view of the portable bathing unit converted to a sofa.
Figure 8:
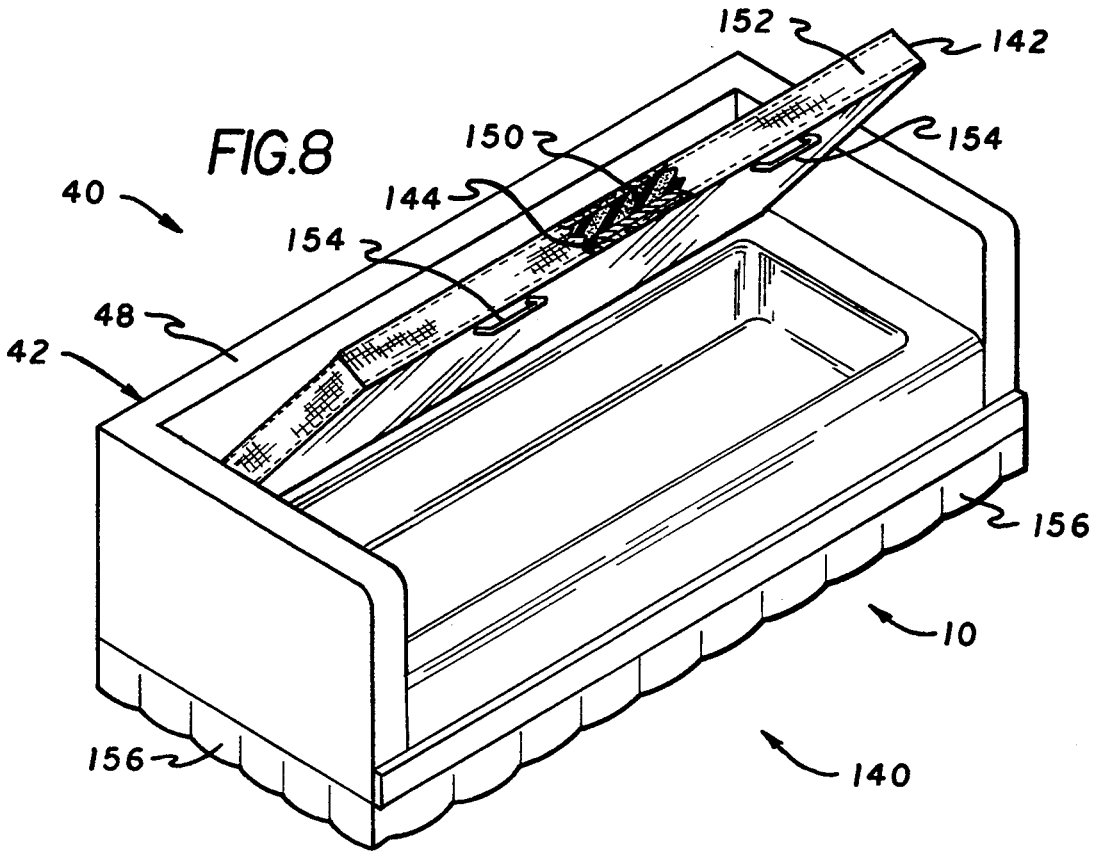
FIG. 8 is a partial perspective view of the sofa shown in FIG. 7 with the cover partially raised.

Outer end panels 60 and an outer rear panel 62 are attached to the outer surfaces of the ends 46 and the rear 48 of the frame 42. The frame 42, in combination with the inner and outer panels 54, 56, and 60, 62, forms a housing. Further, the ends 46 and rear 48 of the frame 42, as well as the inner and outer panels 54, 56 and 60, 62, are preferably cosmetically appealing, each being a decorative wood as is shown in FIG. 1, having a lacquer finish, or being padded and covered with a fabric covering, as is shown in FIGS. 7 and 8.

Figure 4:
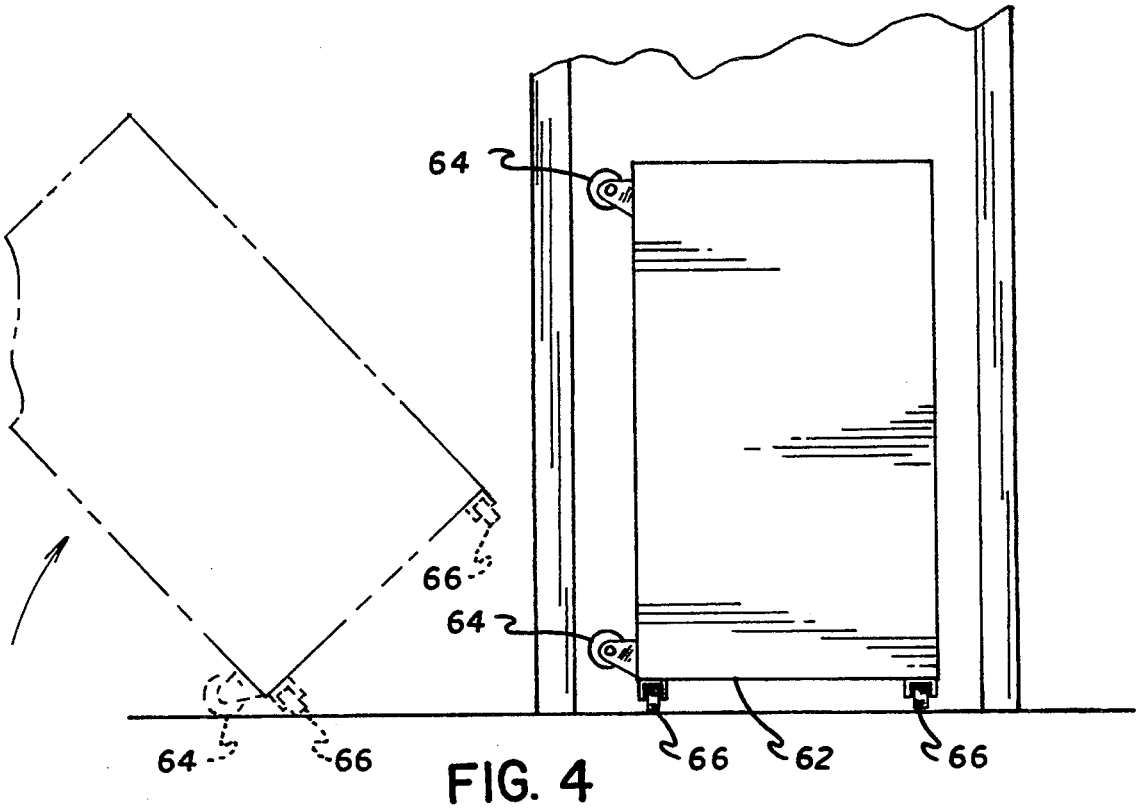
FIG. 4 is a partial side elevational view of the portable bathing unit showing in phantom the same standing upright on the additional casters mounted on the outer rear wall of the housing thereof.

A caster 64 is located on each one of the four corners of the underside of the surface 44 of the frame 42. The casters 64 are heavy duty casters which will sustain the weight of the bath tub 20, as well as the water and the patient using the same. As shown more clearly in FIG. 4, a plurality of additional casters 66 are also individually attached to each one of the four corners of the outer rear panel 62 and the rear 48 of the frame 42. The casters 64, 66 are preferably locking casters which prevent the frame 42 from inadvertently moving.

For a conventional size bath tub, the dimensions of the portable bathing unit 10 are approximately seventy-two inches (1.8 m) in length L, thirty-six inches (1 m) in width W, and twenty-six inches (65 cm) in height H. These dimensions make it difficult to move the portable bathing unit 10 in a upright posture through conventional size doorways D (shown in FIG. 4). The casters 66 disposed on the outer rear wall 62 permit the portable bathing unit 10 to be turned up on its rear and rolled and maneuvered through most conventional size doorways D.

Figure 5:
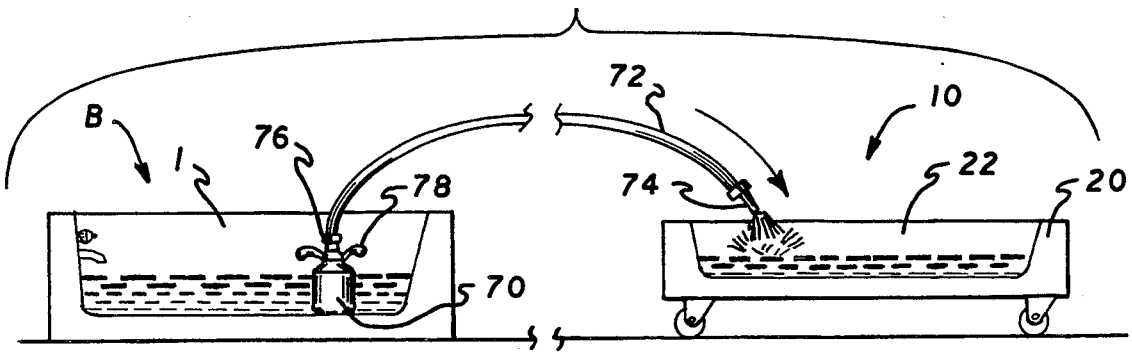
FIG. 5 is a diagrammatic representation of a water delivery and retrieval system for use with the present invention.
Figure 6:
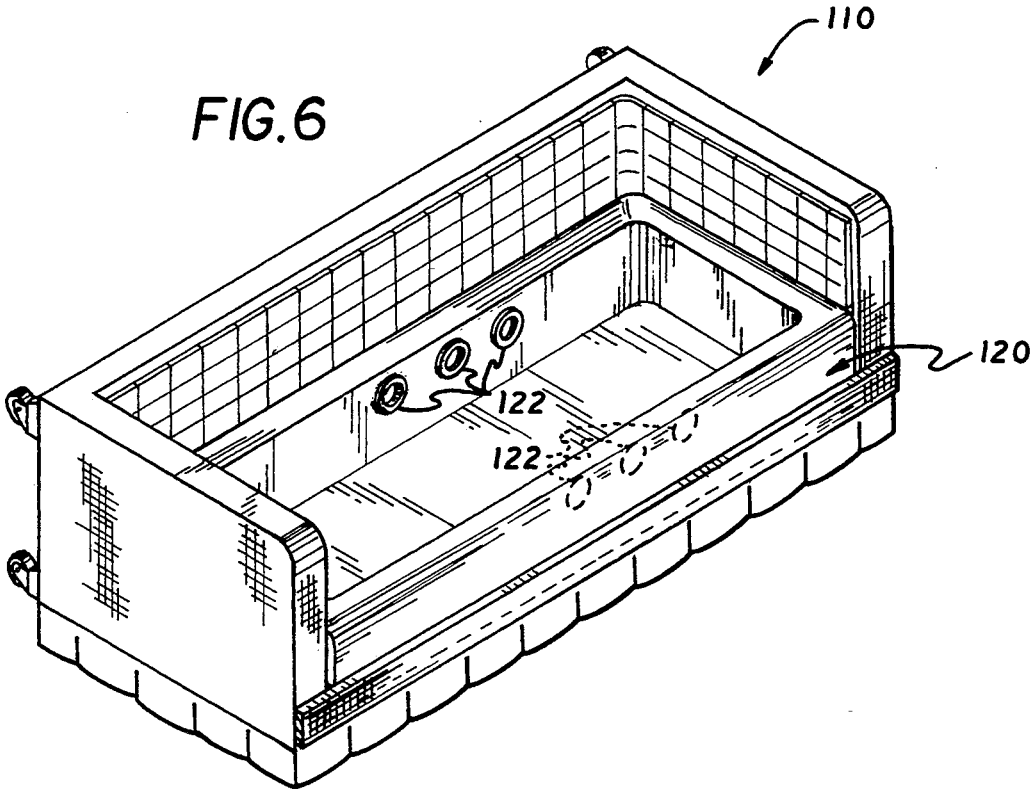
FIG. 6 is a perspective view of an alternative portable bathing unit.

Referring to FIGS. 5, water delivery and retrieval is accomplished through the use of a submersible pump 70 and a segment of conduit 72, such as the conventional garden hose shown. To fill the portable bathing unit 10, a preexisting vessel or bath tub B is filled with water of a desired temperature. An outlet end 74 of the garden hose 72 is placed in communication with the interior 22 of the bath tub 20 of the portable bathing unit 10. An inlet end 76 of the garden hose 72 is connected to the submersible pump 70. The submersible pump 70 is submerged in the preexisting bath tub B and is actuated to pump water through the segment of garden hose 72 from the preexisting bath tub B into the interior 22 of the bath tub 20 of the portable bathing unit 10. Hence, the preexisting bath tub B is drained as the portable bathing unit 10 is filled. To drain the portable bathing unit 10, the outlet end 74 of the garden hose 72 is placed in communication with the interior I of the preexisting bath tub B. Then, the submersible pump 70 is submerged in the bath tub 20 of the portable bathing unit 10 and is actuated to pump water through the segment of garden hose 72 from the interior 22 of the bath tub 20 of the portable bathing unit 10 into the preexisting bath tub B, draining the portable bathing unit 10. This configuration requires the use of only one pump 70 and a segment of garden hose 72 of appropriate length. No special faucets are necessary and no adapters are required for operatively connecting the segment of conduit 72 to the preexisting bath tub B or sink (not shown).

The pump 70 is preferably a $\frac{1}{4}$ HP (175 W) portable unit which pumps from pools as shallow as $\frac{1}{2}$ inch (1 cm) deep and draws water to within $\frac{1}{8}$ inch (3 mm) from the floor. The pump 70 has a screened bottom (not shown) for filtering the water flowing therethrough and includes a $1\frac{1}{4}$ inch (3 cm) discharge and a $\frac{3}{4}$ inch (2 cm) garden hose adapter (also not shown) for connecting the inlet end 76 of the a garden hose 72 thereto. Handles 78 for provided to permit the pump 70 to be easily transported.

Figure 9:
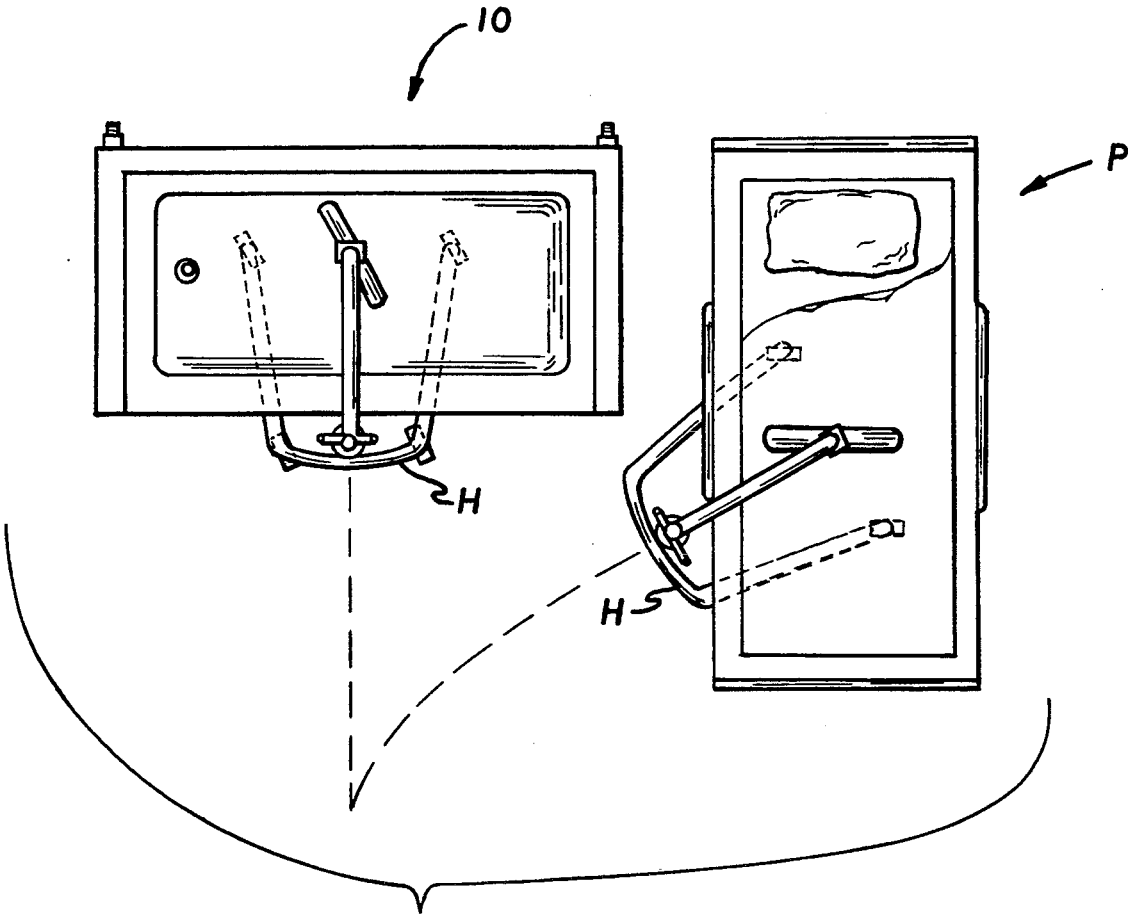
FIG. 9 is a diagrammatic representation of the portable bathing unit in proximity of a patient's bed and in cooperation with a hoist (for carrying a patient).

In an alternative embodiment the portable bathing unit 110 includes a whirlpool bath tub 120, as is shown in FIG. 9. The whirlpool bath 120 shown is provided with six independently adjustable jets 122 and features a $\frac{3}{4}$ HP (550 W) jet system (not shown) including a $\frac{3}{4}$ HP pump which operatively allows the user to customize the water flow through each jet 122 independently. The bath tub surface 124 is a high gloss durable cast acrylic with a durable fiberglass backing.

When the portable bathing unit 10 is not being used for bathing, the same is convertible into a day bed or sofa arrangement 140, as is shown in FIGS. 7 and 8. The frame 42 of the carriage 40 extends upwardly over the upper edge 34 of the bath tub 20 forming armrests 46 at the opposite ends of the bath tub 20 and a backrest 48 along the rear of the bath tub 20. A cover 142 conceals the bathing chamber 22 and forms a seat. The cover 142 is rectangular in shape and has dimensions which extend the length and width of the upper edge 34 of the bath tub 20. A planar panel 144 includes an upper surface and a lower surface. A cushion 150 is attached to the upper surface and a durable fabric 152 is wrapped about both the planar panel 144 and the cushion 150. The fabric 152 may be of a leather or vinyl material which is non-absorbent and which may be effortlessly disinfected. The lower surface of the cover 142 has a pair of handles 154 extending therefrom which permit the cover 142 to be easily handled and maneuvered by the user. Around the bottom edge of the carriage 40 is draped a valance 156 for masking the elevation of the carriage 40 and concealing the casters 64 (shown in FIG. 1).

As shown in FIG. 9, the portable bathing unit 10 may be located in the proximity of the patient's bed P to ensure that a patient would be moved a minimum distance from his or her bed. This reduces the risk of a harmful incident occuring in the course of transporting the patient to and from the portable bathing unit 10. The casters 64 (shown in FIG. 1) elevate the frame 42 high enough above the floor surface to permit the legs of the hoist H (for carrying a patient) to pass thereunder. Conventional baths typically are not elevated and, hence, do not allow the legs of the hoist H to pass thereunder, nor the boom of the hoist to extend over the bath chamber.

It is to be understood that the present invention is not limited to the sole embodiment described above, but encompasses any and all embodiments within the scope of the following claims.

I claim:

1. A portable unit comprising:

a bathing section, a sofa section and a housing;

said housing having a back wall defining a continuous rear flat surface;

said bathing section including:

a bath tub supported by said housing and having a bathing chamber;

means for delivering water to and retrieving water from said bath tub and being used with a preexisting vessel;

said means for delivering water to and retrieving water from said bath tub further including:

a submersion pump selectively insertable into a water filled one of a preexisting vessel for pumping said water into said bath tub and a bath tub for pumping water into a preexisting vessel;

a conduit having an inlet end and an outlet end, said inlet end being attachable to said submersion pump, and said outlet end being selectively insertable into one of said bath tub and a preexisting vessel;

said sofa section including:

a cover member removably mounted on said bathing chamber;

a seat cushion removably supported by said cover member, and a back cushion removably supported by said back wall; whereby, the use of said sofa unit converts said bathing unit into an article of sofa furniture;

said housing including:

a frame having a bottom surface on which said bath tub is supported;

rear and end walls extending upwardly from said bottom surface, and substantially above said bath tub; and a plurality of castes mounted on said bottom surface of said frame and also mounted on said rear flat surface, whereby, said portable unit is rolled either upright or on its side.

2. A portable bathing unit according to claim 1 and further includes a plurality of jets for circulating water in said bath tub.

* * * * *